United States Patent [19]

Taylor

[11] 4,160,226

[45] Jul. 3, 1979

[54] SNAP-ACTING THERMALLY RESPONSIVE ACTUATORS

[76] Inventor: John C. Taylor, 9 Homefield Park, Ballasalla, Castletown, Isle of Man

[21] Appl. No.: 874,012

[22] Filed: Jan. 31, 1978

Related U.S. Application Data

[63] Continuation-in-part of Ser. No. 639,856, Dec. 11, 1975, abandoned.

[30] Foreign Application Priority Data

Dec. 12, 1974 [GB] United Kingdom ..... 53847/74
Oct. 30, 1975 [GB] United Kingdom ..... 45024/75

[51] Int. Cl.[2] ..... H01H 37/52
[52] U.S. Cl. ..... 337/379; 337/111
[58] Field of Search ..... 337/379, 111, 365–368, 337/89, 131, 380, 354; 29/195.5; 200/67 DA; 73/378.3

[56] References Cited

U.S. PATENT DOCUMENTS

| | | | |
|---|---|---|---|
| 1,883,249 | 10/1932 | Spencer | 200/67 DA |
| 1,988,345 | 1/1935 | Vaughn | 73/378.3 |
| 2,863,024 | 12/1958 | Romine | 337/380 |
| 3,110,788 | 11/1963 | Welsh | 337/131 |
| 3,139,500 | 6/1964 | Fallon et al. | 337/354 |
| 3,275,773 | 9/1966 | Grover | 337/365 |
| 3,388,226 | 6/1968 | Willcox | 200/67 DA |

FOREIGN PATENT DOCUMENTS

| | | | |
|---|---|---|---|
| 1102506 | 10/1955 | France | 337/89 |

*Primary Examiner*—Harold Broome

[57] ABSTRACT

A snap-acting thermally responsive actuator comprises a bimetal sheet having a U-shaped aperture defining a tongue, the sheet having been deformed to a domed configuration in a die pressing operation so that the actuator reverses its curvature with a snap-action with changes in temperature. The actuator may carry an electrical contact and have sufficient resistance so that current through the actuator heats the actuator to its operating temperature. The electrical resistance may be increased by forming additional apertures in the actuator.

20 Claims, 11 Drawing Figures

FIG.7.
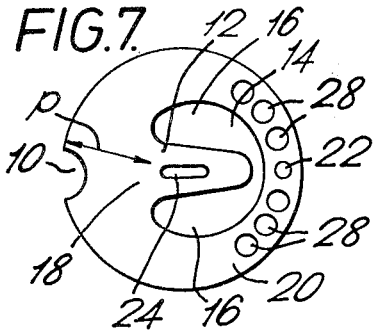
FIG.11.
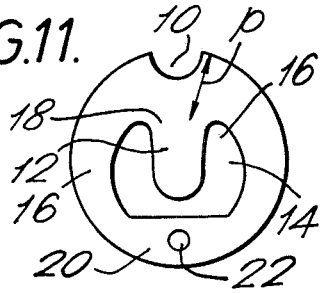
FIG.8.
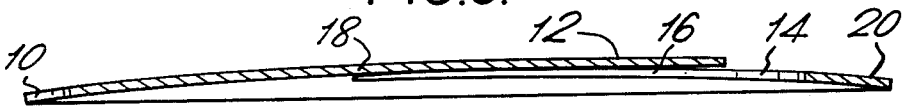
FIG.9.
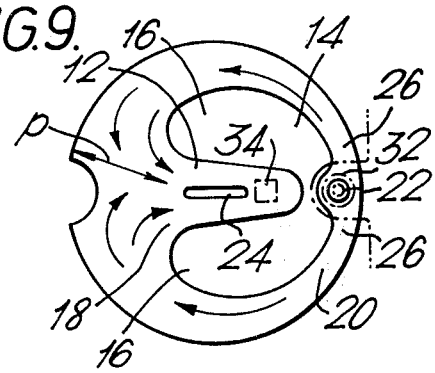
FIG.10.
| FIGURE NUMBER OF ACTUATOR | DIFFERENTIAL IN °C | RANGE OF USEFUL MOVEMENT IN MM. |
|---|---|---|
| 1 | 37 | 0.36 |
| 2 | 37 | 0.32 |
| 3 | 34 | 0.34 |
| 4 | 38 | 0.45 |
| 5 | " | " |
| EQUIVALENT DISC | 40 | 0.14 – 0.18 |

SNAP-ACTING THERMALLY RESPONSIVE ACTUATORS

PRIOR APPLICATION

The present application is a continuation-in-part application of my copending U.S. application Ser. No. 639,856 filed Dec. 11, 1975 now abandoned.

BACKGROUND OF THE INVENTION (1) Field of the Invention

This invention relates to snap acting thermally responsive bimetallic actuators for use in actuating the switch contacts of thermally responsive electric switches such as cut-outs, circuit breakers and thermostats.

(2) Description of the Prior Art

A well known form of bimetallic actuator is a bimetallic disc of domed configuration which moves to an oppositely domed configuration with a snap action with changes in temperature. The simplicity of discs and their ease of manufacture, the basic operation being pressing a flat disc between steel dies to a desired domed configuration, has resulted in their widespread use, despite serious disadvantages.

One disadvantage particularly is that with prior art wide differential discs very high peripheral stress concentrations result during inversion and in consequence the operating temperature at which the disc snaps tends to drift with age and its life is limited by stress-cracking: thus after about 10,000 operations the disc may stress-crack, whilst the operating temperature may have drifted by as much as 20° C. The net result is that in use such discs do not have accurately determined operating temperatures throughout their life.

Another disadvantage of prior art disc type bimetalic actuators is that of their very small range of useful movement with snap-action which is often of the order of the uncertainties in the dimensions of other related components of a switch in which the disc may be incorporated.

In view of the widespread use of discs, extensive research has been made into their characteristics. There have been various proposals over the past 40 or so years to increase the movement and to increase the accuracy of the operating temperature of discs. For example, radial corrugations have been impressed in a disc, stress-relief apertures have been inserted at the centre of a disc and mechanical arrangements for transmitting and increasing the effective movement of a disc have been proposed (see for example British Patent Specification No. 1031827). Despite the large amount of research that has gone into improving the characteristics of discs, none of the various proposals has done anything more than mitigate to a certain extent the disadvantages inherent in bimetal discs.

Another type of snap-acting prior art bimetallic actuator, which is well known and which avoids most of the disadvantages of discs, is that described in British Patent Specification No. 657434. In the preferred form, such an actuator comprises a rectangular sheet or blade of bimetal having a central tongue released from between two outer legs whose ends adjacent the free end of the tongue are joined by a bridge portion. The bridge portion is mechanically crimped to impart a dished configuration to the bimetal blade so that it moves with changes in temperature between oppositely dished configurations with a snap action. Such an actuator has a much larger amount of movement with snap action than a disc. It is also possible accurately to set the operating temperature, which is in any case more stable under repeated use than that of a disc.

The main disadvantage of the actuator of British Patent Specification No. 657434 inherent in the method of deforming the blade by crimping, is that it cannot be mass produced to a closely predetermined operating temperature, and furthermore the life of this actuator, although greater than that of a disc, tends to be shortened by cracks developing in maximum stress concentration areas at the junction of the central tongue with the outer legs.

Thus despite extensive research into and extensive use of various snap-acting bimetallic actuators the need still exists for a thermally responsive snap-acting bimetallic actuator which is suitable for mass production, has a reasonably stable operating temperature over a long working life, and provides an adequate range of useful movement with snap action.

SUMMARY OF THE INVENTION

The present invention provides a snap acting thermally responsive actuator comprising a member of sheet bimetal having a generally U-shaped aperture therein defining a tongue free at one end, an area of said member surrounding said tongue and in relation to which said tongue, at least in part, is generally centrally disposed having been deformed in a die-pressing operation to conform in shape to a die of domed configuration, said domed area being such as to reverse its curvature with a snap action with change in temperature.

By forming an actuator in accordance with the invention by a die-pressing operation, it is possible to mass produce actuators in a particularly simple and effective way. It has been found that actuators according to the invention can be formed in mass-production with more accurately determined operating temperatures, and with better stability, such stability in operating temperature being better not only than that of discs but also than that of bimetallic actuators as described in British Patent Specification No. 657434. This stability arises in large measure from the stress relief in said domed area provided by said U-shaped aperture, and from the method of formation by die-pressing such an actuator which creates few undesired and unintentional local stress concentrations. The lack of such stress concentrations also contributes to an accurately determined operating temperature.

A further and important advantage of an actuator according to the invention is that for many applications its range of useful movement with snap-action can be substantially greater than that of an "equivalent disc," by which is meant an actuator identical to an actuator according to the invention apart from having no U-shaped aperture and hence no tongue.

A practical measure for many purposes of the useful movement of an actuator is the movement at the free end of said tongue with snap action measured from the periphery of the actuator to one side of the actuator against a nominal force of 50 g wt. This useful movement is that which can ordinarily be employed in many typical electrical switches. It has been found that, using the above measure, an actuator according to the invention can provide between two and three times the useful movement of an equivalent disc. It is however the case that the greater the useful movement, the greater the differential, i.e. the difference in operating temperatures for increasing and decreasing ambient temperature, but this is not important for many applications.

This increase in useful movement is explicable in that whilst a disc has only a small useful movement, it develops a comparatively large force (~200 g wt), far greater than that required to open typical switch contacts, so that although relieving the stresses in the centre of an actuator by providing said U-shaped aperture substantially reduces the force developed, this is unimportant for most purposes, and the resultant freedom of movement of the free end of the tongue results in a magnified, still useful movement of the actuator.

In view of this increased useful movement, it is possible to use cheaper types of bimetal sheeting (e.g. Ni-Cr/Ni-Fe laminates) rather than the more expensive types having a high manganese content such as are commonly used in discs.

When designing an actuator according to the invention for a particular switch application, besides being necessary to ensure that the tongue can with snap-action develop a sufficient force and movement to open the switch contacts, it is also desirable to so dispose and shape the U-shaped aperture as to minimise local stress concentrations and thus maximise the working life of the actuator. This consideration results in certain preferred geometrical shapes of actuator.

Accordingly the invention provides in a preferred form a snap acting thermally responsive actuator comprising a member of sheet bimetal having a generally U-shaped aperture therein defining a tongue free at one end, an area of said member surrounding said tongue and in relation to which said tongue, at least in part, is generally centrally disposed having been deformed in a die pressing operation to conform in shape to a die of domed configuration, said domed area being such as to reverse its curvature with a snap action with change in temperature, and wherein the tongue tapers from its root towards its free end, the ends of the U-shaped aperture adjacent the tongue root are rounded, and the width measured generally radially from the centre of said domed area of that part of the domed area in the region of the tongue root is greater than the width of the other parts of said area surrounding said tongue.

The design of the region of the tongue root is important as regards the lifetime of the actuator, since it is here that the high stress concentrations are developed. Sharp corners it this region would tend to provide localised area of very high stress concentrations; these are avoided by providing arcuate portions of the outer perimeter of the aperture smoothly merging at rounded ends of the aperture with the inner perimeter of the aperture adjacent the tongue root.

Whilst it has been found advantageous to have the maximum radial width of the domed area of the actuator in the region of the tongue root, i.e. the width of the domed area surrounding said tongue measured radially from the centre of the domed area being greatest in the region of the tongue root, it is important not elsewhere to so reduce the width of the domed area as to impair the overall mechanical strength of the actuator to the point where it is incapable of delivering the necessary developed force on inversion. However it is preferred that portions of said domed area extending from said aperture rounded ends towards the free end of the tongue progressively reduce in width from said rounded ends towards the free end of said tongue. Preferably such portions reduce to a minimum value of width of the domed area in the region of the free end of said tongue. Preferably said greatest radial width of the domed area is at least twice as great as such minimum value of width.

The tongue must itself have sufficient mechanical strength to deliver the desired force. A tongue of tapered shape lends itself to this requirement whilst minimising any tendency for the tongue itself to invert breadthwise with snap-action of the actuator which would tend to reduce the useful movement of the free end of the tongue. The free end of the tongue is closely spaced from the outer perimeter of the aperture and is disposed intermediate lobe portions of the aperture. The length of the tongue is greater than the width of the tongue as measured at the mid-point of the length of the tongue and is preferably at least 1.4 or optimally 1.5 times greater than such width. The breadth of the tongue at its root is desirably of the same order of magnitude as the width of the domed area in the region of the tongue root. Preferably the greatest width of the domed area in the region of the tongue root is greater than the width of the tongue as measured at the mid-point of the length of the tongue. The angle of taper of the tongue is desirably between 15° to 30°. The shape of the free end of the tongue is not critical. If desired, the free end may be bent to change the reference plane of movement of the actuator. The U-shaped slot defining said tongue is preferably symmetrically disposed about a diameter of the domed area which diameter is also preferably an axis of symmetry, the longitudinal axis of the tongue then coinciding with the said axis of symmetry.

Preferably for convenience in manufacture the bimetal member of the actuator according to the invention is domed over its whole surface although, if desired, some or all of the tongue may not be deformed during the die pressing operation. However other areas of the bimetal member may be provided which are left flat and undeformed; for example flat ears for mounting purposes may be provided extending from the domed area. Whilst the actuator is preferably circular for convenience in forming between dies, it may have other shapes, for example rectangular or elliptical.

Thus an actuator according to the present invention can have various advantageous features, in particular a large range of useful movement and an accurately predetermined and stable operating temperature. Depending on the particular application envisaged, the actuator will be designed to emphasize one or other of such features. Thus for an inexpensive cut-out for high currents, a large range of useful movement will be required to ensure satisfactory operation. However a large range of movement involves a high differential between the operating temperatures of the actuator for increasing and decreasing temperatures and this may be undesirable for example in some forms of thermostat where a low differential is required, but an accurately predetermined and stable operating temperature is necessary. Again, for example, for circuit breakers sensitive to an excess current in a circuit, neither a large range of useful movement nor an accurately predetermined operating temperature is required, merely an adequate range of movement together with a reasonable consistency and stability in the operating temperature so that excess current may reliably be detected.

In some applications, the actuator may be loosely mounted; in other applications the actuator may be welded or rivetted to a mounting boss and may in addition carry an electrical contact. The actuator may suitably be mounted at the free end of its tongue, where the effects on stresses in the actuator will be at a minimum or on the periphery of the actuator opposite the free end of the tongue.

For actuators arranged to be incorporated in current sensitive switches, an electrical contact is mounted on the actuator so that current can pass through the actuator, the actuator being heated above its operating temperature as a result of excess current. A major problem with known current sensitive actuators is to increase their electrical resistance to current flow so that they respond to relatively low currents while ensuring that the actuator is not unduly mechanically weakened. Thus reducing the bimetal thickness and the overall dimensions of an actuator will increase electrical resistance, but it may unduly weaken the actuator. This problem is particularly acute since it is common nowadays to require sensitivity to currents of about 2 amps.

For the production of current sensitivities of such low order, British Pat. No. 1363541 discloses and claims a switch actuating element of the type comprising a sheet or strip of flexible bimetallic material having a tongue released therefrom between two outer legs, the tongue being connected to the sheet or strip at one end and being free of the sheet or strip at the other end, and the sheet or strip being stressed so that it is caused to buckle in two directions so as to be movable with changes in temperature between two positions on either side of an intermediate unstable position with a snap action, wherein the tongue and/or the outer legs of the element have perforations such as to increase the electrical resistance to current flow longitudinally therethrough. The actuator specifically described in British Pat. No. 1363541 is of the type described in British Patent Specification No. 657434 wherein the outer legs are bridged adjacent the free end of the tongue, and the bridging portion is crimped to draw the ends of the legs together.

It has been found that the actuator according to the invention is intrinsically more suitable for use in a current sensitive switch than the actuator described in British Patent Specification No. 657434, which in order to provide the necessary mechanical strength and stability has rather wide legs and tongue and is formed of rather thick bimetal and hence does not have substantial electrical resistance. In contrast the actuator according to the invention, having the stress concentrations necessary for snap action disposed in the periphery and tongue root which are inherently strong and stable regions, may be formed of thin bimetal and of small dimensions.

In order to increase the electrical resistance and hence sensitivity of the actuator according to the invention, the periphery may be narrowed, particularly in the regions generally opposite the free end of the tongue. Alternatively perforations, following British Pat. No. 1363541, may be formed in such regions. The tongue may also be narrowed or alternatively and as preferred for maintaining the strength of the tongue, may have an aperture or apertures, preferably formed as a longitudinal slot. In this way the resistance to electrical current passing through the actuator is sufficiently high that the actuator is self-heated to its operating temperature by a current of 2 amps.

BRIEF DESCRIPTION OF THE DRAWINGS

Preferred embodiments of the invention will now be described with reference to the accompanying drawings wherein:

FIGS. 1 to 7 are plan views of actuators according to the invention, the views being to scale with the dimensions of physical embodiments of such actuators;

FIG. 8 is a cross-sectional view on an enlarged scale along the line 8—8 of FIG. 4;

FIG. 9 is a schematic view of the actuator of FIG. 6 incorporated in an electric switch;

FIG. 10 is a table of parameters for the actuators of FIGS. 1 to 5; and FIG. 11 is a plan view of a further actuator according to the invention, the view being to scale with the dimensions of a physical embodiment of such actuator.

DESCRIPTION OF THE PREFERRED EMBODIMENTS

Figure 5:
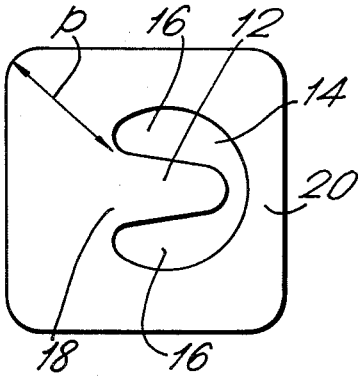

All the actuators shown except that in FIG. 5 have a circular perimeter.

Whilst a circular form is preferred for convenience in mass production, it has been found that that precise shape of the periphery is not critical to the operation of the actuator and that, for example, a rectangular shape may be employed.

Each actuator, apart from that shown in FIG. 5, has a semicircular locating recess 10 in its periphery. Each actuator has a tongue 12, at least in part centrally disposed of the actuator, formed by a generally U-shaped aperture 14 with a generally arcuate outer perimeter.

The actuators are formed in a die pressing operation in which a spherical curvature is imparted over the entire actuator surface. Conventional die pressing operations may be employed. Referring to FIG. 8 showing a cross-sectional view on an enlarged scale of the actuator of FIG. 4 it may be seen that the actuator is provided with a spherical radius of curvature, the radius of curvature being large in relation to the dimensions of the actuator. The other actuators of FIGS. 1 to 7 and 11 have a similar radius of curvature.

The differences between the various actuators shown reside in the shape and position of tongue 12 and aperture 14 and these difference give rise to their differing operating characteristics some of which are indicated in FIG. 10.

The quantities listed in FIG. 10 are for selected actuators all formed by the same method with an equal spherical radius of curvature, a diameter of 12 mm and formed from 0.2 mm thick bimetal. The actuators have been selected as having a break temperature of 100° C. so that their differential and useful movement are comparable. Whilst the values given are representative of the various shapes, they should not necessarily be taken as median values for actuators produced in those particular shapes.

Figure 2:
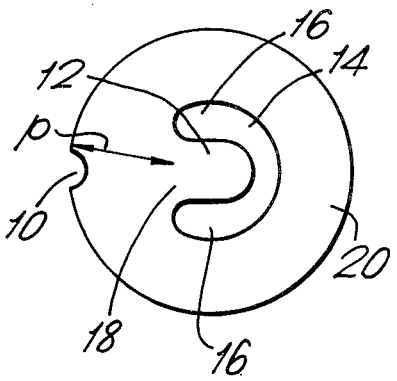
Figure 4:
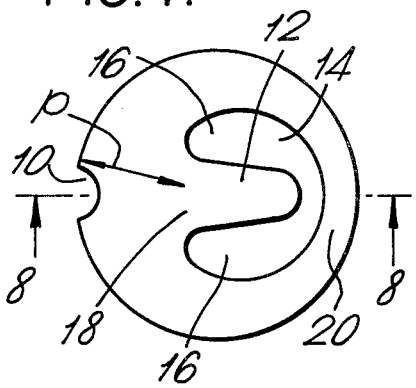

Considering the values given it will be noted that the range of useful movement is considerably greater than that of an equivalent disc, the smallest range being 0.32 mm for the element of FIG. 2, i.e. about 1.8–2.2 times that of an "equivalent disc" whereas the largest range, for the actuators of FIGS. 4 and 5 is 0.45 mm, about 2.5–3 times that of an "equivalent disc".

The differential for the actuators is between 30° and 40° C. The differential for any particular shape is dependent of the movement of the actuator and hence in order to reduce significantly the differential, it will usually be necessary to reduce the movement.

Figure 1:
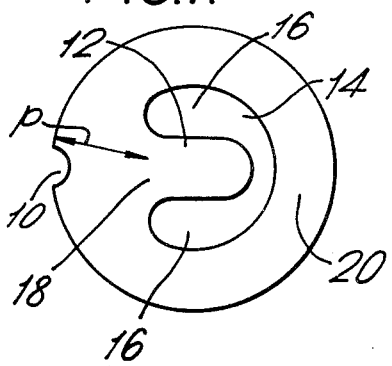

The actuators shown in FIGS. 1 and 2 have a tongue 12 of constant width, 2.5 mm, with a semicircular end. The actuator shown in FIG. 1 has a relatively long tongue measuring 4.5 mm from tip to root. Aperture 14 has relatively large side lobes 16 formed with 1 mm radius rounded ends adjacent the tongue root 18 and a 3.5 mm radius outer perimeter. The margin 20 is of roughly constant radial width, 2.5 mm, although it widens very slightly adjacent the tongue root.

As shown in FIG. 10 a representative value for the useful movement of the actuator of FIG. 1 is 0.36 mm for a differential of 37° C.

Thus it follows for the actuator of FIG. 1 that the end of the tongue 12 is closely spaced from the outer perimeter of the aperture 14 and that the inner perimeter of the aperture 14, defining the tongue, smoothly merges in rounded ends (formed as arcs of circles with 1 mm radius) with the outer perimeter of the aperture adjacent the tongue root 18. The margin 20 widens adjacent the tongue root 18 and the greatest width of the margin surrounding the tongue indicated generally by the dimension p (see FIG. 1), measured radially from the centre of the actuator, is in the region of the tongue root. The length of the tongue, 4.5 mm, is 1.8 times greater than the tongue width (2.5 mm) and the greatest margin width p, being greater than the width of the remainder of the margin 20 (2.5 mm) is also greater than the tongue width (2.5 mm).

The actuator of FIG. 2 has a tongue 12 measuring 3.5 mm from tip to root and an aperture 14 formed with 0.75 mm radius rounded ends adjacent tongue root 18 and a 3.00 mm radius outer perimeter. The margin 20 is of roughly constant width, 3.00 mm. As shown in FIG. 10, a representative value for the useful movement of the actuator of FIG. 2 is 0.32 mm for a differential of 37° C.

Thus it follows for the actuator of FIG. 2 that the ends of the tongue 12 is closely spaced from the outer perimeter of the aperture 14 and that the inner perimeter of the aperture 14 defining the tongue smoothly merges in rounded ends (formed as arcs of circles with 0.75 mm radius) with the outer perimeter of the aperture adjacent the tongue root 18. The margin 20 widens adjacent the tongue root 18 and the greatest width of the margin surrounding the tongue indicated as being in the region of the dimension p of FIG. 2, measured radially from the centre of the actuator, can be seen to be in the region of the tongue root. The length of the tongue is 1.4 times greater than the tongue width (2.5 mm) and the greatest margin width p being necessarily greater than the remainder of the margin 20 (3.5 mm), is also greater than the tongue width (2.5 mm).

The actuators of FIGS. 1 and 2 have constant width tongues and constant width margins. It has been found that constant width tongues are not wholly desirably since, whilst the tongue should be wide at its root for mechanical strength, substantial width in its central regions is undesirable as the tongue tends to invert across its width with snap action of the actuator, resulting in a smaller movement. Similarly a constant width margin is not preferred, rather it has been found that a better compromise of the various design factors involved is achieved by a maximum margin width in the region of the tongue root which width progressively reduces to a minimum opposite the free end of the tongue.

Figure 3:
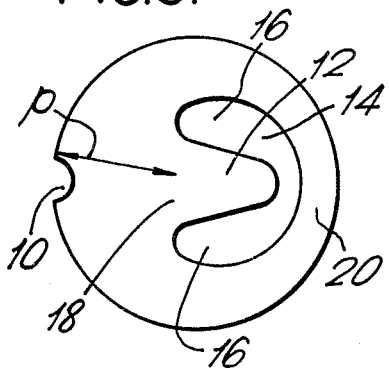

Accordingly the actuators of FIGS. 3 and 4 have tongues tapering from their roots and their margins continuously decreasing from a maximum in the region of the tongue root to a minimum opposite the free end of the tongue.

The actuator of FIG. 3 has a wide tongue root 18, namely 4 mm. The tongue 12 tapers with a 30° taper to a semicircular 1. mm radius free end. The tongue 12 is 4 mm long. The aperture 14 has rounded ends 0.75 mm radius at the tongue root 18 and its outer perimeter is defined by an arc of 3.50 mm radius whose centre is displaced 1 mm from the centre of the actuator. This results in a margin 20 having a maximum width in the region of the tongue root and decreasing continuously to a minimum of 1.5 mm opposite the free end of the tongue. As shown in FIG. 10 a representative value of the useful movement of this actuator is 0.34 mm with a differential of 34° C.

Thus it follows for the actuator of FIG. 3 that the end of the tongue 12 is closely spaced from the outer perimeter of the aperture 14 and that the inner perimeter of the aperture 14 defining the tongue 12 smoothly merges in rounded ends (formed as arcs of circles of 0.75 mm radius ) with the outer perimeter of the aperture adjacent the tongue root 18. The greatest width of the margin 20 surrounding the tongue indicated generally as the dimension p and measured radially from the centre of the actuator is disposed in the region of the tongue root 18. The portions of the margin 20 of the domed area bordering lobes 16 progressively reduce in width from the rounded ends of the aperture toward the free end of the tongue and merge to a minimum width value of 1.5 mm opposite the free end of the tongue 12. The width of the tongue 12, as measured at the mid-point of the length of the tongue, given the length and breadth and angle of taper of the tongue, can be derived as 2.8 mm; thus the length of the tongue 12 (4 mm) is 1.4 times greater than the width of the tongue as measured at the mid-point of the length of the tongue 12.

The greatest radial width p of the margin 20 will be greater than the width of the tongue 12 as measured at the mid-point of the length of the tongue; further this greatest radial width will be more than twice as great as the minimum width of the margin 20 opposite the free end of the tongue. This is because the radius of the outer perimeter of aperture 14 is 3.5 mm and is spaced 1 mm from the centre of the actuator in the direction of the free end of the tongue 12; thus it follows the dimension P is greater than 3.5 mm. Hence the greatest radial width p of the margin 20 is also greater than the width (2.8 mm) of the tongue 12 at the mid-point of the length of the tongue 12 and is more than twice as great as the minimum radial with (1.5 mm) of the margin 20 opposite the free end of the tongue.

In FIG. 4, the actuator tongue 12 tapers at 15° from a tongue root 18 3.5 mm wide to a rounded free end with a 1 mm radius. The tongue 12 is 4.5 mm long. The aperture 14 has rounded ends of 0.75 mm radius adjacent the tongue root 18 and the outer perimeter of the aperture 14 is defined by an arc of 3.5 mm radius whose centre is spaced 1 mm from the centre of the actuator. Thus the margin 20 has a maximum radial with in the region of the tongue root decreasing to a minimum of 1.5 mm opposite the free end of the tongue. From FIG. 10, a representative value of the useful movement of the actuator is 0.45 mm with 38° C. differential. It has been found that the actuator of FIG. 4 offers overall minimum stress concentrations as a result of its flowing contours. The wide margin at the tongue root provides ample strength in the snap action movement and the actuator has proved to have a very stable break temperature (2°-3° C. after 10.000 operations) and it has no abnormally high local stress concentrations where cracking is likely to occur.

Thus it allows for the actuator of FIG. 4 that the end of the tongue 12 is closely spaced from the outer perimeter of the aperture 14, that the inner perimeter of the aperture 14 defining the tongue smoothly merges in rounded ends (formed as arcs of circles of 0.75 mm radius ) with the outer perimeter adjacent the tongue root 18. The greatest width of the margin 20 surrounding the tongue indicated generally as the dimension p and measured radially from the centre of the actuator is disposed in the region of the tongue root 18. The portions of the margin 20 of the domed area bordering lobes 16 progressively reduce in width from the rounded ends of the aperture toward the free end of the tongue 12 and merge to a minimum width value of 1.5 mm opposite the free end of the tongue. The width of the tongue 12, measured at the mid-point of the length of the tongue, given the length and breadth and angle of taper of the tongue, can be derived as 2.8 mm; thus the length of the tongue 4.5 mm is 1.6 times greater than the width of the tongue 12 as measured at the mid-point of the length of the tongue 12.

The greatest radial width p of the margin 20 in the region of the tongue root 18 will be greater than the width of the tongue 12 as measured at the mid-point of the length of the tongue; further this greatest radial width p will be more than twice as great as the minimum width of the margin 20 opposite the free end of the tongue. This is because the radius of the outer perimeter 14 is 3.5 mm and is spaced 1 mm from the centre of the actuator in the direction of the free end of the tongue 12. Thus it follows that the dimension p is greater than 3.5 mm. Hence the greatest width p of the margin 20 is also greater than the width (2.8 mm) of the tongue 12 at the mid-point of the length of the tongue and is also more than twice as great as the minimum width (1.5 mm) of the margin 20 opposite the free end of the tongue 12.

The actuator of FIG. 5 has an internal shape of tongue and aperture exactly the same as that of FIG. 4, but has a 12 mm square periphery. It has been found that the range of useful movement of the actuator of FIG. 5 is similar to that of FIG. 4.

Figure 6:
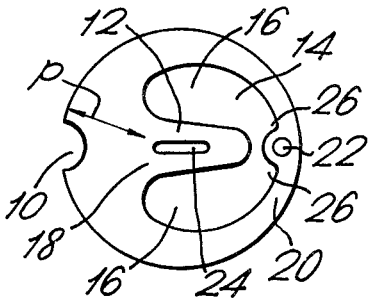

The actuators of FIGS. 6 and 7 are intended for use with current sensitive switches (contact-breakers) and have a contact 22 welded to the margin 20 opposite the free end of tongue 12.

Such arrangement is shown in FIG. 9 wherein there is shown an actuator as shown in FIG. 6 connected in an electrical switch having a stationary contact 32 disposed for engaging with movable contact 22 of the switch welded to the margin 20 of the actuator. The actuator is mounted at the free end of its tongue 12 by a mounting boss 34 which serves as an electrical terminal. Thus in use of the switch current flows through contacts 22, 32 through the margin 20 as indicated schematically by the arrows in FIG. 9 and through the tongue root 18 and tongue 12 to mounting boss 34. As current flows the actuator is heated and at a predetermined temperature of the actuator the actuator snap acts to an oppositely dished configuration wherein the movable contact 22 is disengaged from the stationary contact 32.

Both actuators of FIGS. 6 and 7 have the same general configuration as that shown in FIG. 4, but in order to increase their electrical resistance to current flow, they are smaller, being 10 mm in diameter, and are formed from 0.1 mm thick bimetal. Both actuators have a longitudinal slot 24 in tongue 12 to increase electrical resistance. The actuators of FIG. 7 has three circular apertures 28 located to either side of the contact 22 in the narrowest portion of margin 20 and the presence of these apertures serves substantially to increase electrical resistance. The actuator of FIG. 6, instead of being provided with apertures in its margin 20, has its margin in the region 26 either side of contact 22 substantially narrowed as compared with the margin in FIG. 7 whilst still being thick enough to ensure that sufficient force is produced in the snap action. This also serves substantially to increase electrical resistance.

Both of the actuators of FIGS. 6 and 7 are sensitive to currents as low as 2 amps to perform a snap action movement.

Various other arrangements may be envisaged for increasing electrical resistance. Thus the tongue may be split into two separate tongue portions each extending from the same tongue root.

The electrical contact need not necessarily be positioned on the periphery adjacent the free end of the tongue but could for example be positioned on the tongue itself or any other convenient position. In addition more than one contact may be employed.

Reference is now made to the embodiment of a thermally responsive actuator according to the invention as shown in FIG. 11. The actuator has a circular outer perimeter which is 9 mm in diameter, the outer perimeter having a semicircular locating recess 10. An aperture 14 is formed in the actuator having relatively large side lobes 16. The inner perimeter of the aperture defines a tongue 12 free at one end intermediate side lobes 16. The inner perimeter of the aperture and arcuate portions of the outer perimeter smoothly merge at rounded ends of the aperture at the end of lobes 16 and adjacent the tongue root 18. The margin 20 surrounding the tongue root 18 is widened in the region generally opposite the tongue free end and carries an electrical contact 22; the outer perimeter of the aperture is formed as a straight line in this widened region.

The tongue 12 is of generally constant width extending from its free end to about its mid point along its length. The tongues tapers outwardly with an angle of taper of 15° from such mid point to the tongue root 18.

The free end of the tongue 12 is closely spaced from the outer perimeter of the aperture 14 and the inner perimeter of the aperture 14 defining tongue 12 smoothly merges in rounded ends (formed as arcs of circles) with arcuate portions of the outer perimeter. Such arcuate portions have a radius of curvature of 2.8 mm with a centre of curvature disposed on the longitudinal axis of the tongue and spaced 0.5 mm from the centre of the actuator in the direction of the free end of the tongue. The greatest width of the margin 20 surrounding the tongue indicated generally as the dimension p and measured radially from the centre of the actuator is disposed in the region of the tongue root 18 and amounts to 3 mm.

The portions of the margin 20 of the domed area bordering lobes 16 progressively reduce in width from the rounded ends of the aperture toward the free end of the tongue and each portion has a minimum width value of 1.4 mm at the point where each portion merges with the widened portion of the margin 20 opposite the free end of tongue 12. The maximum value of width of such widened portion 20 along the axis of symmetry of the actuator is 2.0 mm. The width of the tongue as measured at the mid-point of the length of the tongue is 2.0 mm. The length of the tongue is 3.5 mm, 1.75 times greater than the length of the tongue.

The greatest radial width p of margin 20 (3.0 mm) is greater than the width of the tongue (2.0 mm) as measured at the mid-point of the length of the tongue and further this width p is more than twice as great as the minimum width (1.4 mm) of the margin 20 generally opposite the free end of the tongue.

What is claimed is:

1. A snap-acting thermally responsive bimetallic actuator comprising a bimetallic sheet member having an aperture with an outer perimeter and an inner perimeter defining a tongue free at one intermediate two lobe portions of said aperture, said inner perimeter and arcuate portions of said outer perimeter smoothly merging at rounded ends of the aperture adjacent the tongue root, an area of said member surrounding said tongue and in relation to which said tongue at least in part is generally centrally disposed having been deformed in a die pressing operation to conform in shape to a die of domed configuration, said domed area being such as to reverse its curvature with a snap action with change in temperature, the width of the domed area surrounding said tongue measured radially from the centre of the domed area being greatest in the region of the tongue root, and the length of the tongue being greater than the width of the tongue as measured at the mid-point of the length of the tongue.

2. An actuator as claimed in claim 1 wherein the length of the tongue is at least 1.4 times greater than the width of the tongue as measured at the mid-point of the length of the tongue.

3. An actuator as claimed in claim 1 wherein the length of the tongue is at least 1.5 times greater than the width of the tongue measured at the mid-point of the length of the tongue.

4. An actuator as claimed in claim 1 wherein portions of said domed area bordering said lobe portions of said aperture and extending from said aperture rounded ends toward the free end of said tongue progressively reduce in width from said rounded ends towards the free end of said tongue.

5. An actuator as claimed in claim 4 wherein the width of said portions of said domed area each reduce to a minimum value of the width of the domed area in the region of the free end of said tongue.

6. An actuator as claimed in claim 5 wherein said greatest radial width is at least twice as great as said minimum width.

7. An actuator as claimed in claim 1 wherein said greatest radial width of said domed area in the region of the tongue root is greater than the width of the tongue as measured at the mid-point of the length of the tongue.

8. An actuator as claimed in claim 1 wherein the rounded ends of said aperture have the form of arcs of circles.

9. An actuator as claimed in claim 1 wherein the tongue tapers from its root towards its free end.

10. An actuator as claimed in claim 9 wherein the angle of taper is between 15° and 30°.

11. An actuator as claimed in claim 1 wherein said aperture is symmetrically disposed about a diameter of said domed area.

12. An actuator as claimed in claim 11 wherein said diameter is an axis of symmetry.

13. An actuator as claimed in claim 1 wherein the actuator is domed over its entire surface.

14. An actuator as claimed in clain 1 wherein the actuator is a disc having a circular configuration.

15. An actuator as claimed in claim 1 wherein an electrical contact is mounted on said domed area at a point disposed generally opposite the free end of said tongue.

16. An actuator as claimed in claim 1 wherein at least a portion of said member in the region generally opposite the free end of the tongue has sufficiently small dimensions to impart the main resistance to electrical current passing through the actuator.

17. An actuator as claimed in claim 1 wherein apertures are formed in said member generally opposite the free end of said tongue so as to increase the resistance to current flow therethrough.

18. An actuator as claimed in claim 1 formed such that the resistance to electrical current passing therethrough is sufficiently high that the actuator is self-heated to its operating temperature by a current of 2 amps.

19. An actuator as claimed in claim 1 wherein at least one aperture is formed in said tongue to increase the resistance to current flow therethrough.

20. A snap-acting thermally responsive bimetallic actuator comprising a bimetallic sheet member having an aperture with an outer perimeter and an inner perimeter defining a tongue free at one end said inner perimeter and arcuate portions of said outer perimeter smoothly merging at rounded ends of the aperture adjacent the tongue root, an area of said member surrounding said tongue and in relation to which said tongue at least in part is generally centrally disposed having been deformed in a die pressing operation to conform in shape to a die of domed configuration, said domed area being such as to reverse its curvature with a snap-action with change in temperature, the width of the domed area measured radially from the centre of the domed area being greatest in the region of the tongue root, portions of said domed area extending from said rounded aperture ends towards said free end of the tongue progressively reducing in width towards the free end of said tongue, the length of the tongue being at least 1.5 times greater than the width of the tongue measured at the mid-point of the length of the tongue, and the greatest radial width of the domed area in the region on the tongue root being greater than the width of the tongue as measured at the mid-point of the length of the tongue.

* * * * *